US005218919A

United States Patent [19]

Krulikowski, III et al.

[11] Patent Number: 5,218,919

[45] Date of Patent: Jun. 15, 1993

[54] METHOD AND DEVICE FOR THE INSTALLATION OF DOUBLE HULL PROTECTION

[75] Inventors: Joseph W. Krulikowski, III, Philadelphia, Pa.; Bohdan Dunas, Cinnaminson, N.J.; David W. Hart, Wilmington, Del.

[73] Assignee: Special Projects Research Corp., Phila., Pa.

[21] Appl. No.: 656,791

[22] Filed: Feb. 19, 1991

[51] Int. Cl.[5] ..... B03B 25/12

[52] U.S. Cl. ..... 114/74 A; 114/83; 114/84; 188/374; 293/133

[58] Field of Search ..... 114/11, 12, 13, 74 A, 114/79 R, 79 W, 80, 81, 83, 84, 87, 88; 293/133; 188/377, 374, 371; 296/189

[56] References Cited

U.S. PATENT DOCUMENTS

| | | | |
|---|---|---|---|
| 808,467 | 12/1905 | Molloy | 114/83 |
| 1,065,549 | 6/1913 | Reid et al. | 114/79 R |
| 1,257,525 | 2/1918 | Piasecky | 114/13 |
| 1,299,697 | 4/1919 | Ferrati et al. | 114/78 |
| 1,930,285 | 10/1933 | Robinson | 114/79 W |
| 2,175,983 | 10/1939 | Walsh | 114/79 R |
| 2,298,661 | 10/1942 | Swanson | 114/11 |
| 2,405,590 | 8/1946 | Mason | 114/12 |
| 3,482,653 | 12/1969 | Maki et al. | 188/374 |
| 3,599,757 | 8/1971 | Takamatsu | 293/133 |
| 3,939,791 | 2/1976 | Rothrock | 114/74 A |
| 4,181,198 | 1/1980 | Lindberg | 293/133 |
| 4,907,524 | 3/1990 | Hart et al. | 114/356 |

FOREIGN PATENT DOCUMENTS

| | | | |
|---|---|---|---|
| 5439 | 2/1921 | Netherlands | 114/74 R |
| 215920 | 10/1967 | Sweden | 114/74 A |
| 701759 | 12/1953 | United Kingdom | 114/79 R |
| 1108822 | 4/1968 | United Kingdom | 114/83 |

*Primary Examiner*—Sherman Basinger
*Assistant Examiner*—Thomas J. Brahan
*Attorney, Agent, or Firm*—Arthur P. Gershman

[57] ABSTRACT

A method and device for constructing a auxiliary hull, exterior to the primary hull of a ship, which has the capacity to absorb impact energy preventing primary hull puncture, and can be easily retrofitted to existing ship hulls. This method and device involves the use of energy absorbing members arranged in a truss-like formation to support the auxiliary hull shell. The auxiliary hull shell can be laminated to weaken interlaminar shear strength and further increase energy absorption during impact and thus prevent auxiliary hull puncture. This method and device also allows for the void spaces created between the primary and auxiliary hull shells to be filled with material which will, distribute the impact forces to the primary hull over a wider primary hull area, serve to support the auxiliary hull shell under hydrostatic forces and provide additional buoyancy forces if the auxiliary hull shell is punctured.

9 Claims, 13 Drawing Sheets

METHOD AND DEVICE FOR THE INSTALLATION OF DOUBLE HULL PROTECTION

BACKGROUND OF THE INVENTION

1. Field of the Invention

The present invention relates to a method and device for constructing a auxiliary hull exterior to the existing primary hull of a ship. This invention will prevent punctures of the primary hull from impact and collision.

2. Description of the Prior Art

In the past, most double hulled construction was comprised of inner bottoms and side shell bulkheads. While this method was expensive, it was feasible for new construction. For retrofit construction this method is prohibitively expensive and impractical. During retrofit the installation of inner bottom and bulkhead plating is extremely difficult due to access and interference problems. Also this results in the loss of ship's capacity in addition to expensive piping modifications.

SUMMARY OF THE INVENTION

The object of this invention is to provide a method and device regarding the installation of double bottoms and double hulls on existing ships. This method and device for constructing a auxiliary hull, exterior to the primary hull, has the capacity to absorb impact energy preventing primary hull puncture, and can be easily retrofited to existing ship hulls. This method involves the use of members and or energy absorbing compression and tension members arranged in a truss-like formation to support the auxiliary hull shell. The auxiliary hull shell can be laminated to weaken interlaminar shear strength and further increase energy absorption during impact and thus prevent auxiliary hull puncture. This method also allows for the void spaces created between the primary and auxiliary hull shells to be filled with material which will, distribute the impact forces to the primary hull over a wider primary hull area, serve to support the auxiliary hull shell under hydrostatic forces, provide lateral support to the truss members and plating, and will minimize the loss of buoyancy forces due to auxiliary hull rupture from impact. Cost saving advantages of this invention are; ease of installation due to truss-like construction which permits the use of easily managed tools, reduced time of installation due to simplified production and labor requirements, and lower cost of materials. Technical advantages of this invention are; reduce hull punctures and loss of buoyancy by the use of energy absorbing and load distributing designs and materials, increased payload by allowing potable water and other nonpollutant tanks between primary and auxiliary hulls, allow for pipe runs outside the primary hull, and maintain or potentially increase payload by adding less weight then additional added buoyancy. An additional, and significant, technical advantage includes the ability to control primary hull stresses in the auxiliary hull by using stress/deflection control devices. A more complete understanding of the invention may be had by review of the figures and description of the preferred embodiment.

BRIEF DESCRIPTION OF THE DRAWINGS

Certain embodiments of the invention are shown, reference being made to the accompanying drawings, in which.

DESCRIPTION OF THE PREFERRED EMBODIMENT

The accompanying FIGS. 1 through 20 show the preferred embodiment of the invention which is a method and device for constructing a auxiliary hull exterior to the primary hull of a ship, which has the capacity to absorb impact energy and prevent primary hull puncture.

Figure 1:
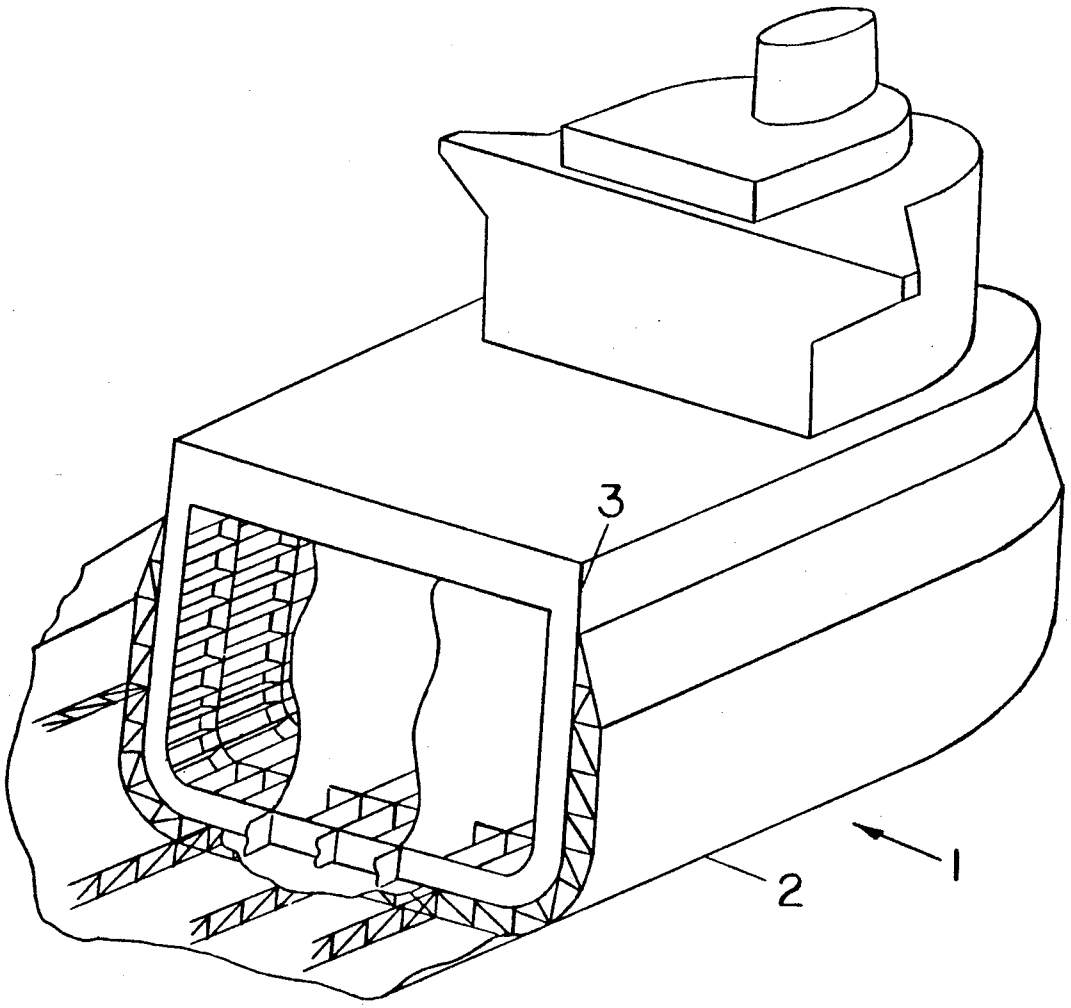
FIG. 1 is a isometric view of the after portion of a tanker ship with a transverse cut line, illustrating the invention.

FIG. 1 is an isometric of the after portion of a tanker ship illustrating the auxiliary hull denoted by the number 1 comprised of an auxiliary hull shell 2 and steel truss members 4, which is attached to the primary hull 3.

Figure 2:
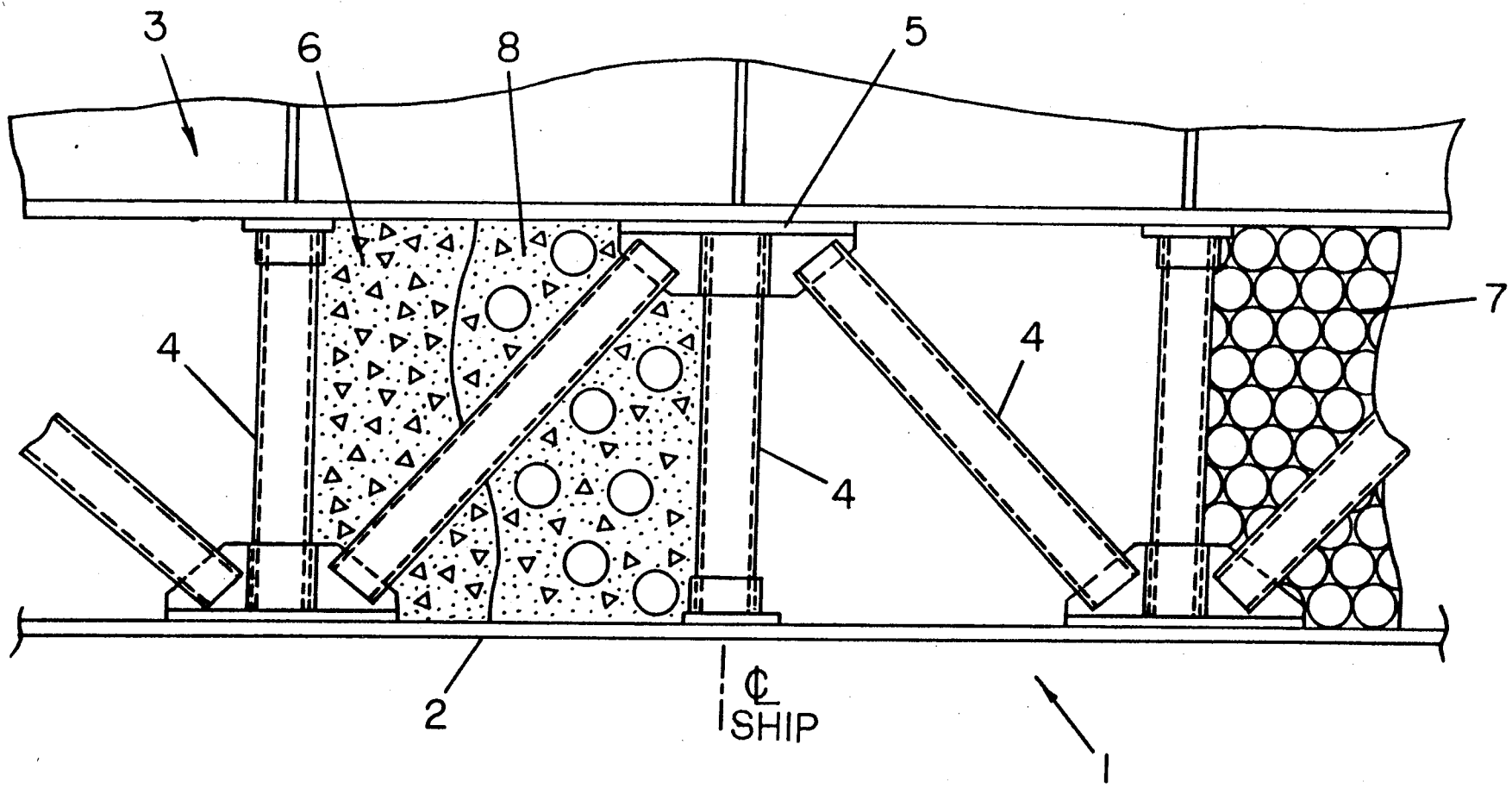
FIG. 2 is an elevation view of the truss structure oriented in the ships transverse direction, illustrating the truss members and the use of different void fill materials.

FIG. 2 is a typical transverse cross section illustrating the assembly of the auxiliary hull 1. The auxiliary hull shell 2, is a steel plate which is held in place by steel truss members 4, which are supported by the primary hull 3, at locations having interior ships structure 12 so as to minimize primary hull deformations. The auxiliary hull shell 2, is welded to the steel truss members 4, which in turn are welded to the primary hull 3 using socket and gusset type connections 5. Lateral support for the steel truss members 4 may be provided by filling the void between the auxiliary hull shell 2 and primary hull 3, with a energy absorbing rigid polyurethane foam material 6, or a energy absorbing polyurethane ball shaped material 7, or a composition of polyurethane foam/ball material 8. The preferred embodiment is the use of polyurethane foam/ball material 8. This combination makes for a light weight, water tight and easily applied composite material effective in reducing steel truss member 4 size and weight, by laterally restraining the member, which increases buckling strength and the energy absorbed by the member before failure. It is also effective in supporting the auxiliary hull shell 2, of the auxiliary hull 1, under normal hydrostatic loads. The polyurethane foam/ball material 8 is effective in absorbing energy as it resists loads and fails during collisions. Localized loads on the auxiliary hull shell 2 are dispersed within the polyurethane foam/ball material 8 and reach the primary hull 3 over a much larger area eliminating failure of the primary hull 3. The expected ultimate compressive strength of the polyurethane foam/ball material is 400 pounds per square inch. The use of this polyurethane foam/ball material 8 significantly reduces buoyancy loss due to auxiliary hull 1 puncture since the polyurethane foam/ball material 8 is water tight.

Figure 3:
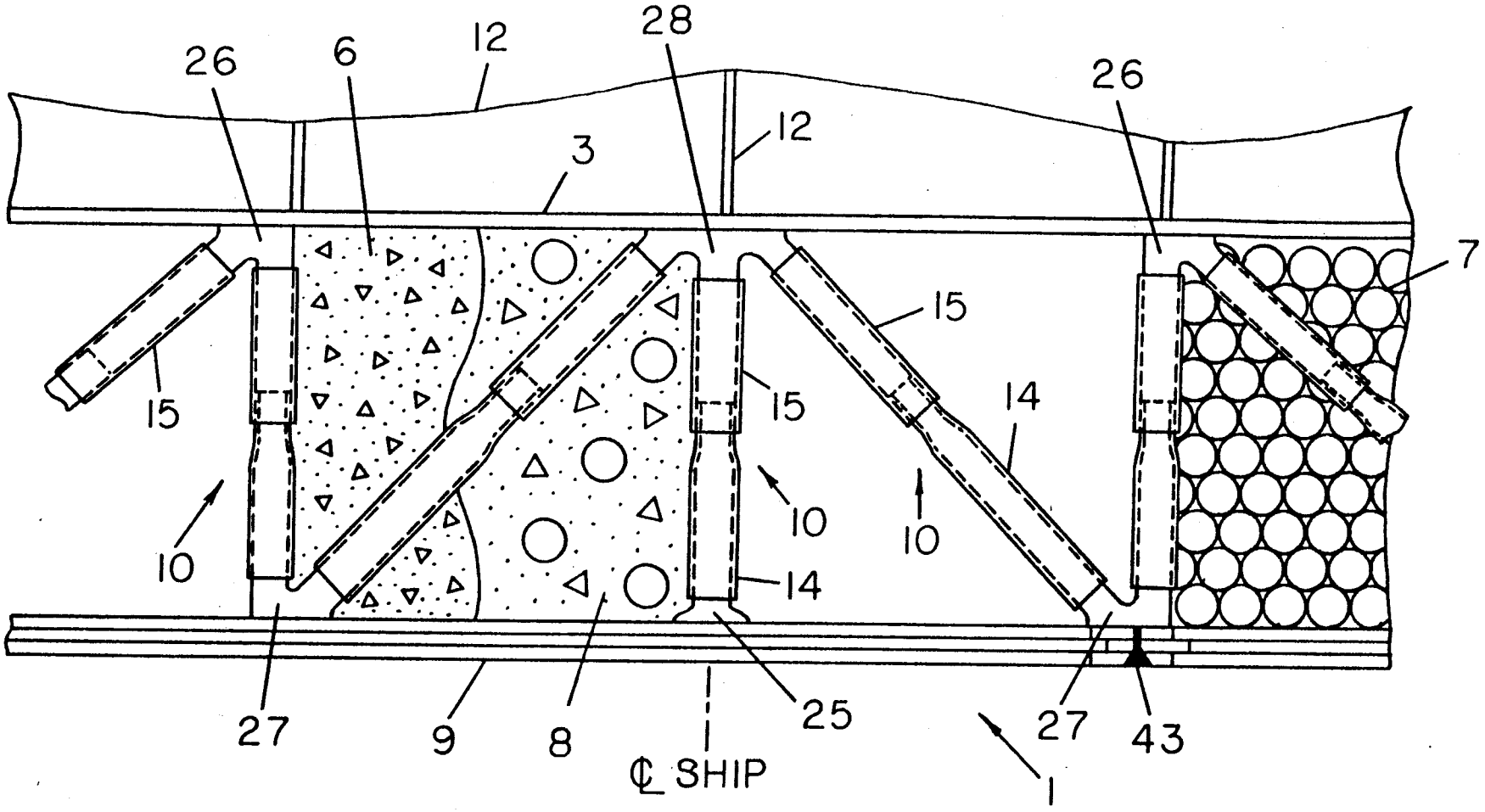
FIG. 3 is an elevation view of the truss structure oriented in the ships transverse direction, illustrating the use of energy absorbing compression truss member assemblies and cast joint devices.
Figure 5:
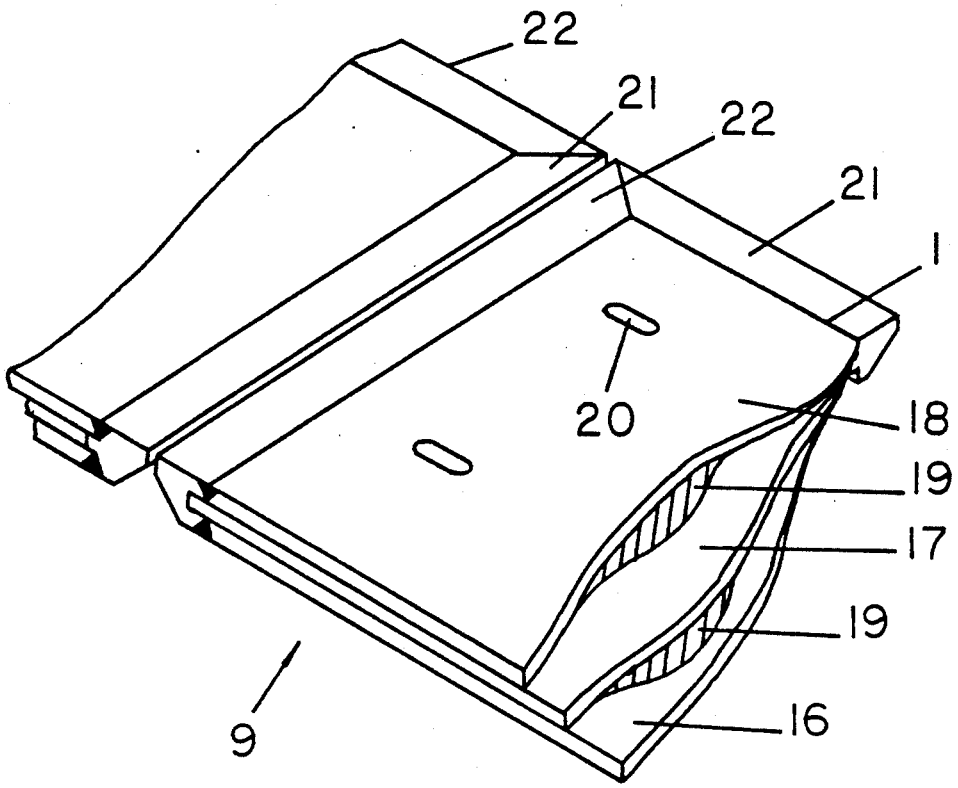
FIG. 5 is an isometric view of the auxiliary hull shell, illustrating the use of laminated plating and associated butt joint design.

FIG. 3 is a typical transverse cross section of the second version of the preferred embodiment illustrating the assembly of the auxiliary hull 1. The laminated plate assembly 9, further illustrated in FIG. 5, is a laminated plate assembly which is held in place by steel energy absorbing compression truss member assemblies 10, which are supported by the primary hull 3, at locations having interior ships structure 12 so as to minimize primary hull deformations. The diagonal compression truss member assemblies 10 have been arranged in opposite directions, as referenced from the ship's centerline, for maximum energy absorption during a side collision. The laminated plate assembly 9, is welded to the energy absorbing compression truss member assemblies 10, which in turn are welded to the primary hull 3, using cast joint devices 25, 26, 27 or 28, which are further illustrated in FIGS. 7, 8, 9, and 10. Lateral support for the compression truss member assemblies 10, can be provided by filling the void between the laminated plate assembly 9 and primary hull 3, with the described foam material 6, or ball shaped material 7, or a composition of foam/ball material 8. The energy absorbing compression truss member assemblies 10 are comprised of two steel tube elements 14 and 15, which are connected via a male female joint. The sequence of the energy absorbing mechanism is as follows. Initially when impact is made a compressive force is generated in the compression truss member assembly 10. The weld attaching the two steel tube elements 14 and 15 of this member assembly 10 will absorb load until its shear capacity is reached. Failure of the weld will occur allowing the member assembly 10 to shorten as the two elements 14 and 15 are pressed together. Three positive effects for energy absorption are occurring during this phase of the mechanism. First, as the tapered portion of element 14 enters element 15, elastic/plastic circumferential strains begin in both elements absorbing energy as they progress. Second, the two elements wanting to retain their unstrained cross sectional shape impart a large normal pressure upon themselves relative to the outside surface of element 14 and the inside surface of element 15. This pressure multiplied by the interface area, again multiplied by the coefficient of dynamic friction gives the column compressive force required to maintain a constant rate of member shortening at any time. Noting that the interface area continues to increase as the member shortens, the force required to maintain a constant rate of shortening must also increase. This mechanism is very effective in absorbing a large amount of energy. Third, the compressive loads acting on the member assembly 10 are oriented axially relative to the member assembly. The member assembly 10 may then be considered a column under compression and therefore column buckling is of concern. The nature of the energy absorbing mechanism effectively counters column buckling tendencies in two ways; one, the member assembly shortens as the mechanism progresses, and two, the center cross section of the member assembly increases as the two elements mate. Both conditions dramatically increases the stiffness of the member reducing the possibility of buckling.

Figure 4:
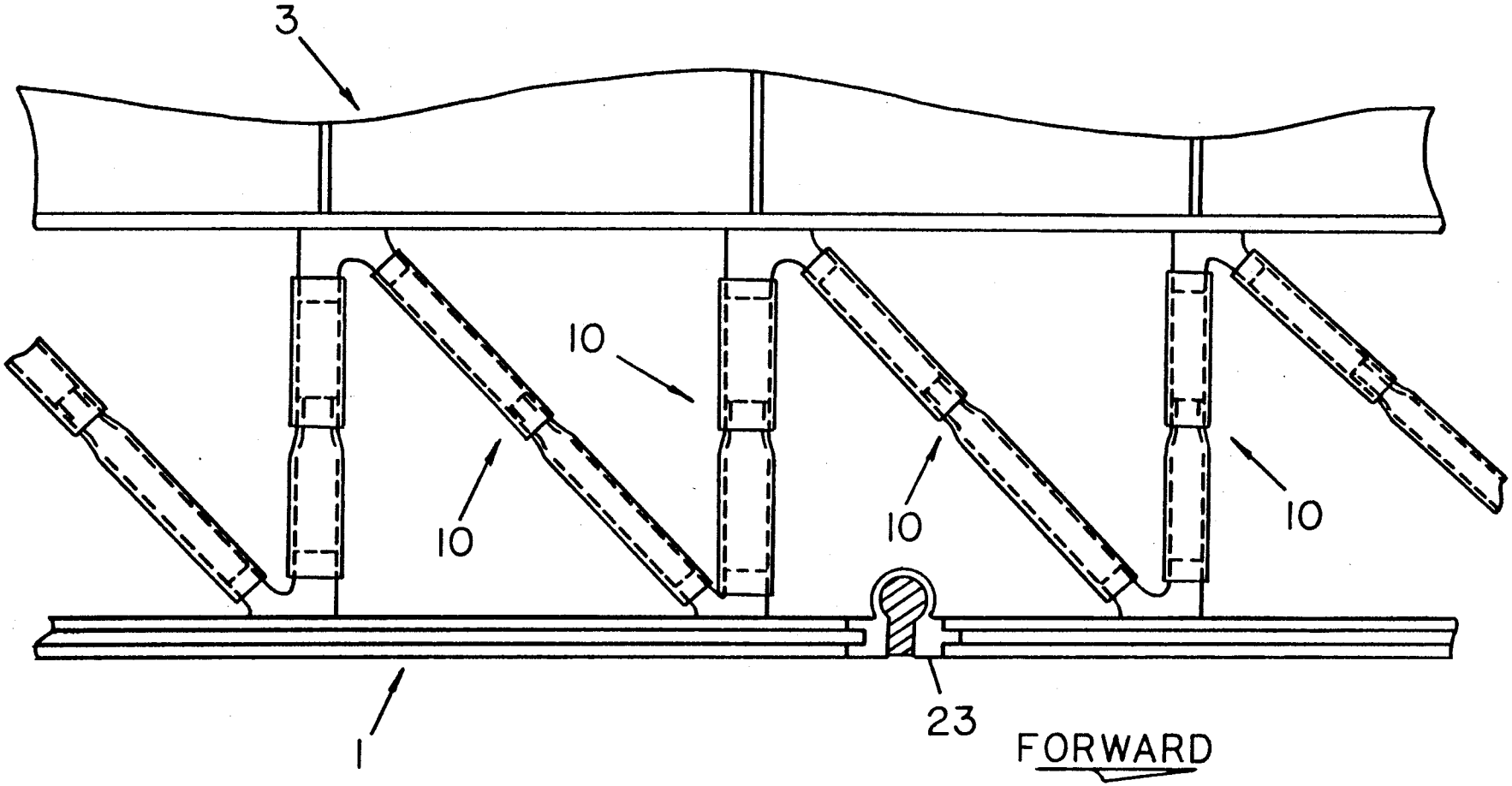
FIG. 4 is an elevation view of the truss structure oriented in the ships longitudinal direction, illustrating the truss member assemblies configured to provide compressive resistance under probable impact forces.

FIG. 4 is a typical longitudinal cross section of the second preferred embodiment illustrating the auxiliary hull 1 with the truss diagonal compression truss member assemblies 10 arranged in a downward and forward direction from the primary hull 3 for maximum energy absorption during a forward collision. A stress/deflection controlling device 23 is illustrated to show proper arrangement to relieve primary hull bending stresses.

FIG. 5 is an isometric of the laminated plate assembly 9, that is comprised of an exterior plate 16, center plate 17, and interior plate 18 attached by the use of a structural adhesive 19 or a slot weld 20, end tongue piece 21 and end groove piece 22. End tongue piece 21 and end groove piece 22, are used to permit shell welds 43 in joining the laminated plate assemblies 9. This laminated plate assembly 9 acts as a solid plate under operational loads, however interlaminar shear forces under collision will be high enough to fail the plate bonds allowing the plate to belly and thus avoiding plate tearing. The polyurethane foam/ball material 8, as shown in FIG. 3, would then take more of the collision load and distribute it to the primary hull 3 over a large area eliminating localized failures of the primary hull 3. Since by nature structural adhesives are waterproof, and allowable corrosion limits are specified in ship design, the plate thicknesses of the laminated plate assembly 9 can be adjusted such that the exterior plate 16 is equal to or less than the specified limit. This results in the structural adhesive 19 acting as a natural corrosion barrier when the exterior plate 16 has corroded through thus delaying further corrosion.

Figure 6:
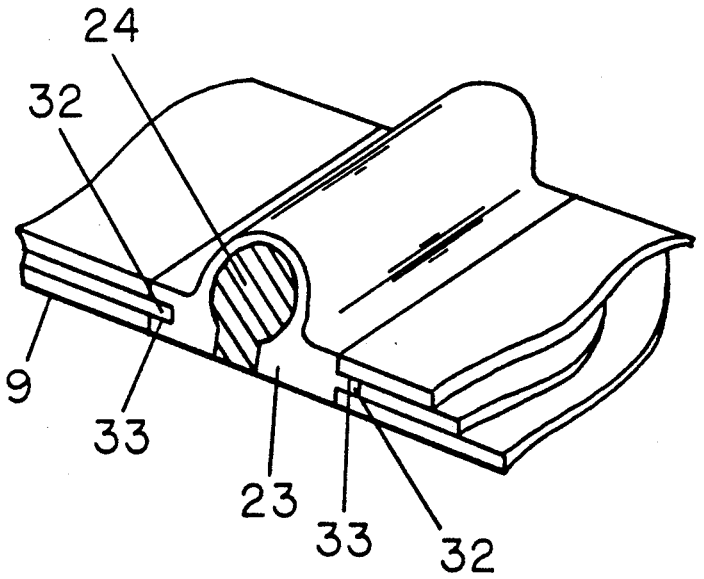
FIG. 6 is an isometric view of a laminated plate assembly and a stress/deflection controlling device which has the capability to relieve loads and allow deflection in the laminated plate assembly.

FIG. 6 is an isometric of a stress/deflection controlling device 23 which provides for deflection control thereby controlling the amount of stress in the laminated plate assembly 9 caused by deflection from bending of the primary hull 3 which is denoted in FIG. 4. The cross section of this stress/deflection controlling devise 23 allows considerable deflection when plane loads in the laminated plate assembly 9 act perpendicular to its long axis. This devise 23, as shown, is an omega shape, however it can be any offset geometric shape, welded between sections of laminated plate assembly 9. The welded connection is formed with a tongue 32 and groove 33. The interior of this devise 23 is filled with a flexible material 24, such as rubber or silicone caulk. This will make for a smooth shell and therefore less resistance as the hull travels through the water.

Figure 7:
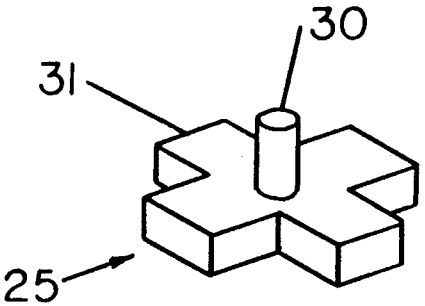
FIG. 7 is an isometric view of a cast joint device with a single appendage, used to attach a member or member assembly to the auxiliary hull shell or to the primary hull.
Figure 10:
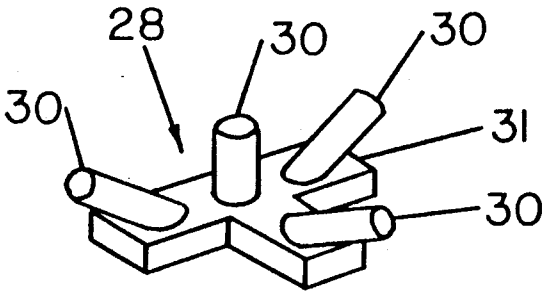
FIG. 10 is an isometric view of a cast joint device with four appendages, used to attach members or member assemblies to the auxiliary hull shell or to the primary hull.
Figure 9:
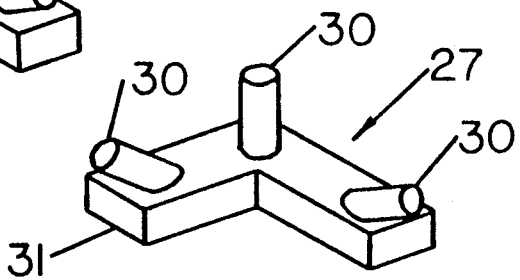
FIG. 9 is an isometric view of a cast joint device with three appendages, used to attach members or member assemblies to the auxiliary hull shell or to the primary hull.
Figure 11:
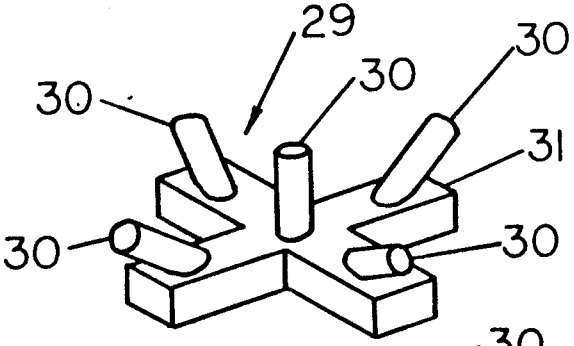
FIG. 11 is an isometric view of a cast joint device with five appendages, used to attach members or member assemblies to the auxiliary hull shell or to the primary hull.
Figure 8:
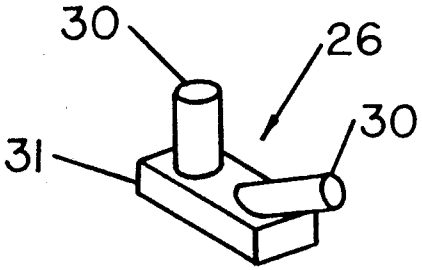
FIG. 8 is an isometric view of a cast joint device with two appendages, used to attach members or member assemblies to the auxiliary hull shell or to the primary hull.

FIG. 7 is an isometric of a cast joint device 25 comprised of an appendage 30 and base 31 for a single truss member assembly. The appendage 30 matches the inside geometry of the steel tube elements and allows for easy adjustment of truss member assembly length by providing a range of locations suitable for welding along the length of the appendage 30. This appendage 30 can be cast economically in a large number of predetermined angular positions to receive steel tube elements such that a variety of standard cast joint devices can be used in different locations to facilitate fabrication. The base 31 of the cast joint device 25 can be cast in various root geometries to facilitate welding preparation. The device 25 can be welded to the outer side of the primary hull 3 or to the inner side of the auxiliary hull 1 as shown in FIG. 3. In this preferred embodiment five types of cast joint devises are utilized.

FIGS. 8, 9, 10 and 11 illustrate the different types of cast joint devises 26 through 29 with varying number of connection appendages 30 and base 31 geometries. These cast joint devises welded to the outer side of the primary hull 3, as shown in FIGS. 3 and 4, at locations having interior ships structure 12 so as to minimize primary hull deformations. The width 11 of the bases 31 of devices 25 through 29 will be based on the thickness of the shell plating to avoid secondary stresses caused by truss member assembly loading. The loads in the truss member assemblies will be transferred to the primary hull structure by way of these cast joint devises.

Figure 12:
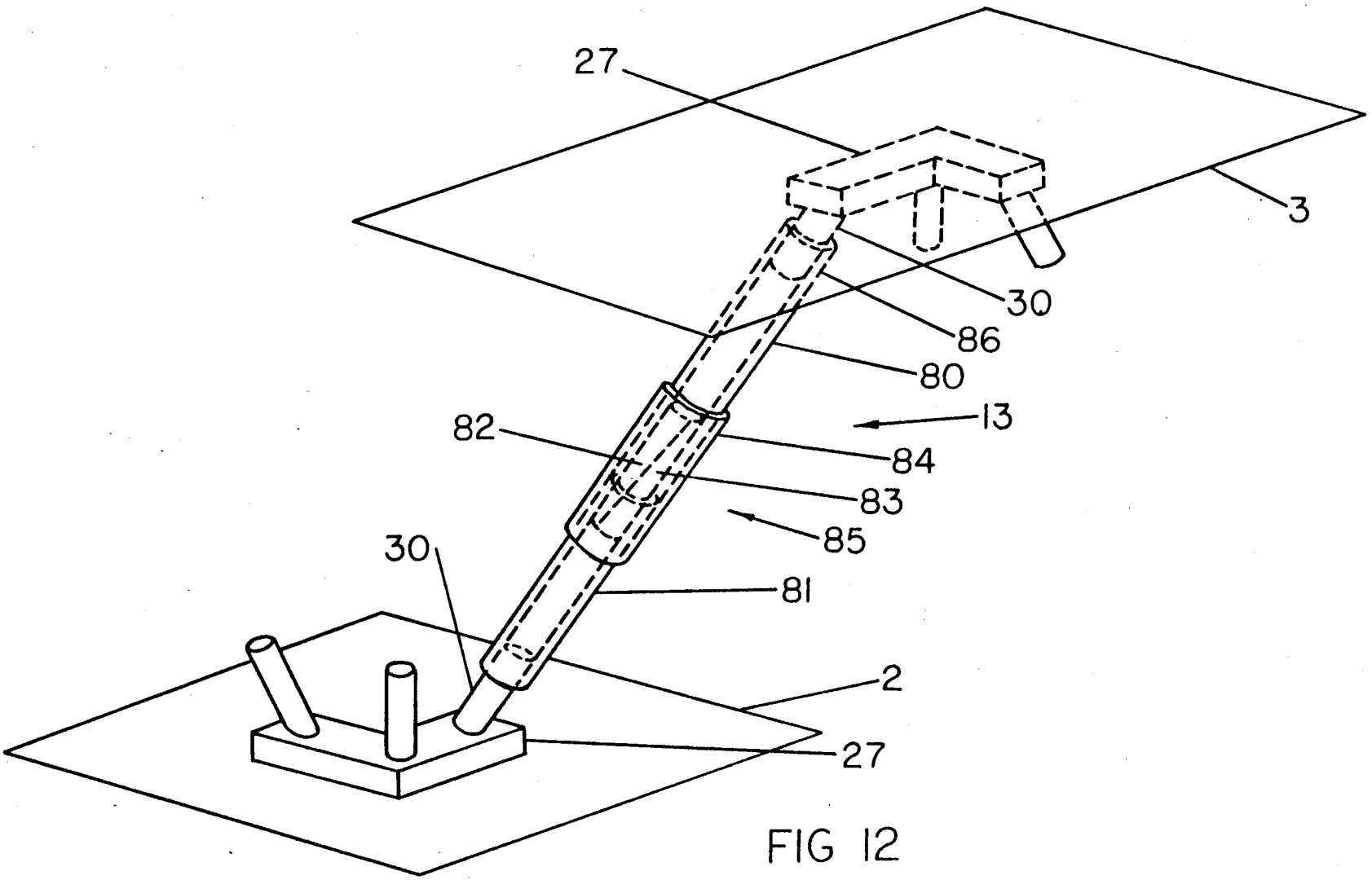
FIG. 12 is an isometric view of a truss member assembly, illustrating the use of energy absorbing tension truss member assemblies.

FIG. 12 is an isometric of a energy absorbing tension truss member assembly 13. This tension truss member assembly 13 shown in a cylindrical shape with a circular cross-section could have substantially any shaped cross-section. As depicted, the steel tube element 80 and steel tube element 81 are connected using two wedges 82 and 83 and a sleeve 84. The two wedges 82 and 83 are formed such that when the inclined faces are mated the resultant outside diameter will substantially match the inside diameter of the two steel tube elements 80 and 81 respectively. The inside diameter of the sleeve 84 substantially matches the outside diameter of the two steel tube elements 80 and 81. Either steel tube element 80 or 81 can be inserted into sleeve 84. Sleeve 84 can be pushed along the steel tube element out of the way of the tube element interface 85. The wedges 82 and 83 can be mated and inserted into the interface end of steel tube element 80. The thin end of the wedge 83 can be welded to the steel tube element 80. Steel tube element 81 can then be slid onto the two wedges 82 and 83. Connection to the cast joint device 27, and truss member assembly 13 length, can be made by sliding steel tube element 81 onto the wedges 82 and 83 as far as possible, inserting the female end 86 of steel tube element 80 onto the appendage 30 of the cast joint device 27 which is attached to the primary hull 3, rotating the tension truss member assembly 13 so that it is in line with the appendage 30 of the cast joint device 27 which is attached to the auxiliary hull shell 2, then sliding steel tube element 81 onto the appendage 30 of cast joint device 27, adjusting for proper fit and welding steel tube element 81 to wedge 82. Next, welding steel tube element 80 and 81 to their respective cast joint devices 27, sliding the sleeve 84 over the wedges 82 and 83 and welding to steel tube elements legs 80 and 81. The following is the mechanism allowing for energy absorption under truss member assembly 13 tension loading. Under tension load, one of the sleeve's 84 circumferential welds attached to the steel tube element 80 or 81 will fail. This allows for the two steel tube elements 80 and 81 to begin separating and drawing their respective wedges with them. The wedges 82 and 83 move in opposite directions causing their combined cross-sectional area to increase. This area increase is resisted by the circumferential strength of the steel tube elements 80 and 81 and sleeve 84. Additionally, since the steel tube elements 80 and 81 and sleeve 84 have a certain amount of elasticity, a pressure is imparted at the interface of the wedges 82 and 83, and steel tube elements 80 and 81. There is a frictional force resistive to relative movement as this mechanism progresses. The frictional forces are dependant on the intensity of the pressure and the associated area of the pressure. A substantial amount of energy is absorbed with this mechanism.

Figure 13:
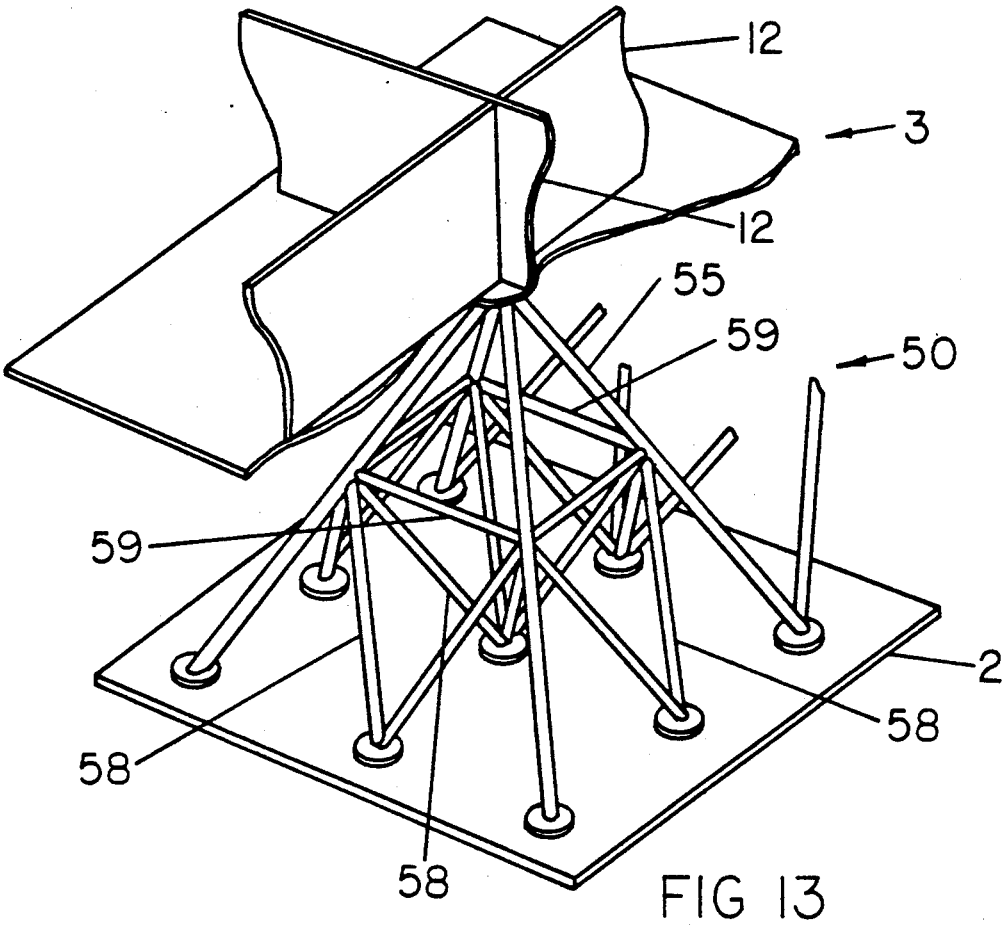
FIG. 13 is an isometric view of a space truss assembly, illustrating the support of the auxiliary hull shell.

FIG. 13 is an isometric of a space truss assembly 50 which is utilized where larger distances are needed between primary hull 3 and auxiliary hull shell 2 or if additional support of the auxiliary hull shell 2 is required. The outer member assembly 55 of the space truss assembly 50 may have energy absorbing compression properties similar to that of the compression truss member assembly 10 in FIG. 3 or energy absorbing tension properties similar to that of the tension truss member assembly 13 in FIG. 12. Intermediate diagonal member 58 provides structural support for the space truss assembly 50 Intermediate horizontal member 59 provides lateral support for outer member assembly 55. As drawn and described in this embodiment the space truss assembly 50 has nine base points attached to the auxiliary hull shell 2 and one top point attached to the primary hull 3. This design as compared to a planer truss structure illustrated in FIG. 2, FIG. 3 and FIG. 4, provides greater support and reduces panel size to one quarter the area for the auxiliary hull shell 2.

Figure 14:
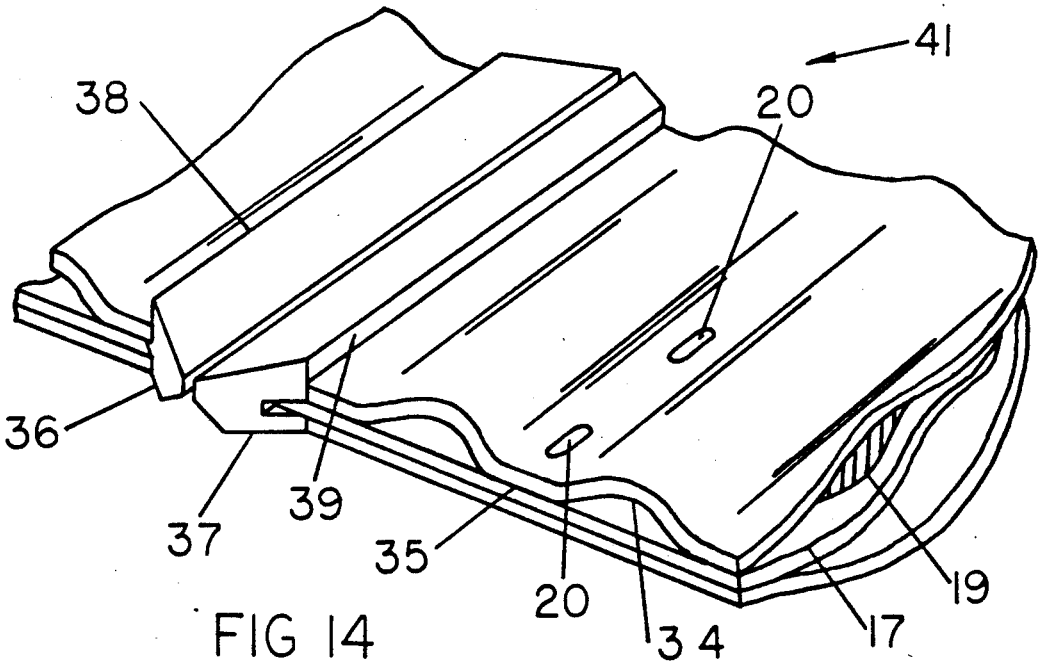
FIG. 14 is an isometric view of the auxiliary hull shell illustrating the use of laminated plating with the interior plate shaped for additional strength.

FIG. 14 is an isometric of an alternate form of the laminated plate assembly 9, shown in FIG. 5, where a shaped interior plate 34 is used to provide additional stiffness to resist bending of the shaped laminated plate assembly 41. The lower surface 35 of this shaped interior plate 34 has been contoured to facilitate bonding with center plate 17 using a structural adhesive 19 or a slot weld 20. End tongue piece 36 and end groove piece 37 are similar to 21 and 22 of FIG. 5, except for a raised top interface surface 38 and 39 to facilitate welding of the shaped interior plate 34.

Figure 15:
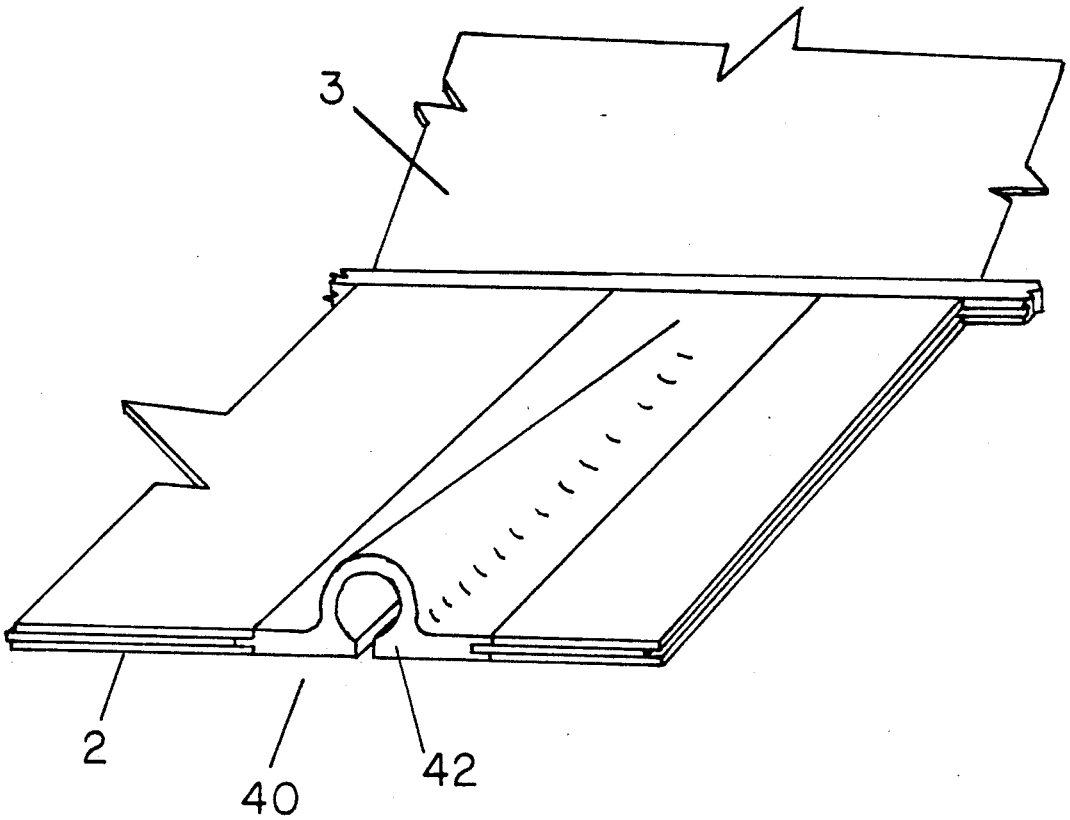
FIG. 15 is an isometric view of a transition piece for the stress/deflection controlling device.

FIG. 15 is an isometric of a transition stress/deflection controlling device 40. The cross section 42 is a geometric shape which has been tapered to allow for transition between the auxiliary hull shell 2 and the primary hull 3. The cross section 44 is flatten to avoid any secondary or excessive stresses from the deflection of the device 40.

Figure 16:
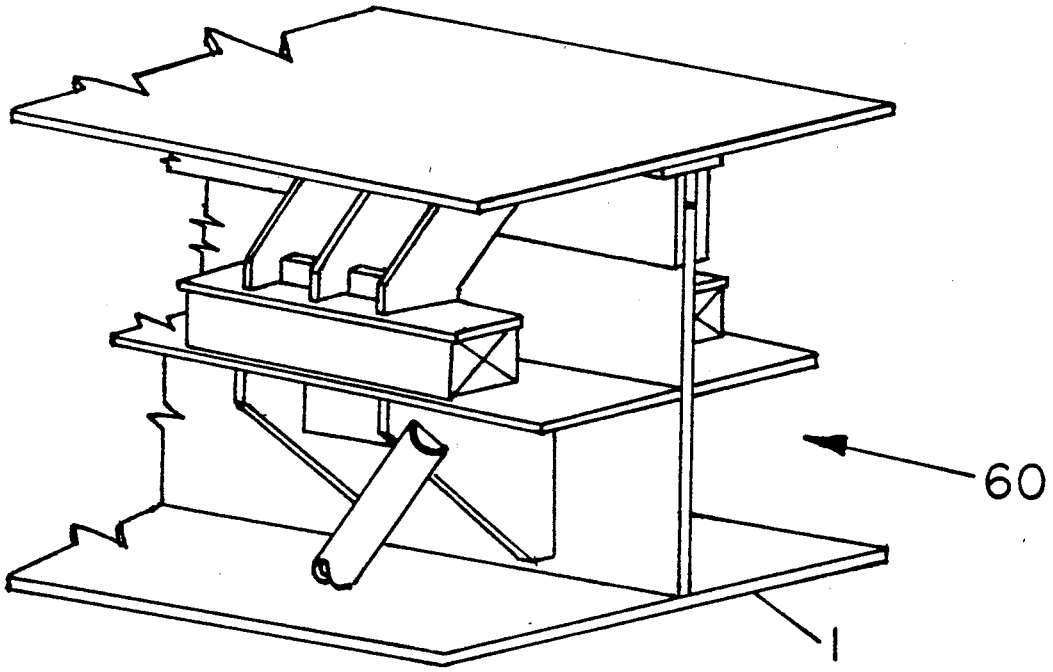
FIG. 16 is a isometric view of the construction support assembly.

FIG. 16 is an isometric of the construction support assembly 60. This construction support assembly 60 allows for the maximum pre-arrival construction of the auxiliary hull 1. Said assembly 60 allows for easily deformable support points for load distribution, and allows the ship to be dry-docked over its new auxiliary hull 1. Compression truss member assemblies 10, as shown in FIG. 3, and tension truss member assemblies 13, as shown in FIG. 12, because of the length adjustment nature of their construction, to allow for docking clearance and ease of installation due to primary hull and auxiliary hull irregularities, can be recessed before final positioning and welding.

Figure 17:
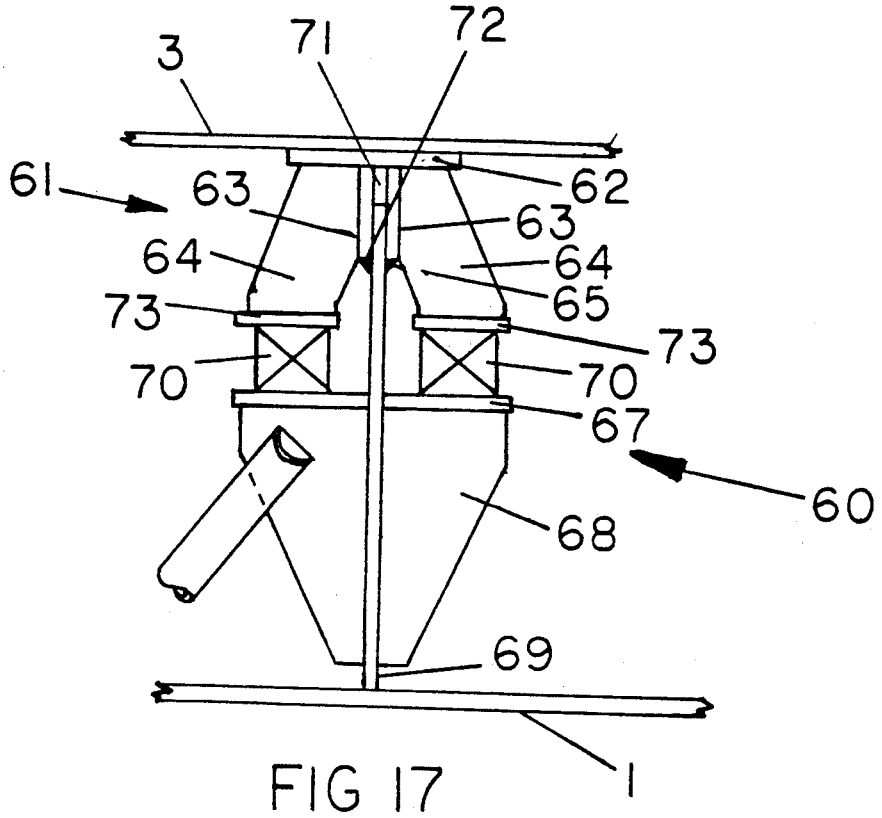
FIG. 17 is an elevation view of the details for the construction support assembly.

FIG. 17 is a cross section of the construction support assembly 60. The upper yoke assembly 61 is a weldment which provides a slot 71 to allow movement for proper load distribution of the block loads, along the primary hull 3, during dry-docking and serve as a guide to maintain alignment with the lower plating 69. Block material 70 is an easily deformable material such as wood which will permit easy redistribution of docking loads similar to conventional docking blocks. The top plate 62 of the upper yoke assembly 61 distributes loads and can be easily welded to the primary hull 3. Side plates 63 are positioned to form a slot 71. The lower surfaces 65 of the side plates 63 have been trimmed to provide clearance for welds 72 after docking, with the lower support plate 73 of the upper yoke assembly 61. Once docked the upper yoke assembly 61 can be welded to the lower plating 69 to permit the construction support assembly 60 to act as a permanent load carrying member. Side chocks 64 connect the top plate 62 to the lower support plate 73 and act to transfer load during docking. Support shelf 67 provides support for the block material 70. The lower side chocks 68 provide structural support for both the support shelf 67 and the lower plating 69. The construction support assembly 60, because of the extra support provided by the support shelf 67 and lower support plate 73, will act as a energy absorbing member during a collision. Once welded in place the construction support assembly 60 will allow for conventional dry-docking on the new auxiliary hull 1, by transferring loads directly to ships primary docking structures.

Figure 18:
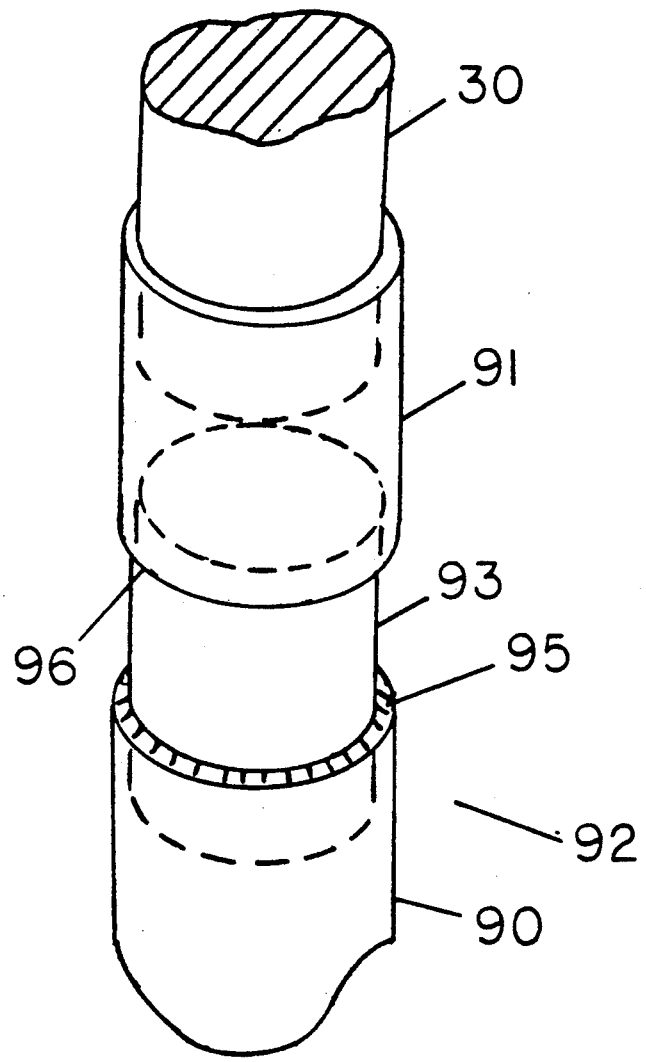
FIG. 18 is an isometric view of a portion of a compression truss member assembly capable of supporting load after initial failure.

FIG. 18 is an isometric of a compression truss member assembly 92 formed by a steel tube element 90 and a steel tube element 91 which are connected to an intermediate guide 93 using upper weld 96 and lower attachment weld 95. Intermediate guide 93 is of smaller cross-section which will fit into steel tube elements 90 and 91. Failure of the lower attachment weld 95, due to compressive axial loads, will cause the compression truss member assembly 92 to shorten in length until the steel tube element 90 mates and is supported by the new interface formed by the upper weld 96 and the failed lower attachment weld 95. This new truss member assembly configuration, because of its reduced length will support increased load and will increase the impact energy absorbing capacity of the compression truss member assembly 92.

Figure 19:
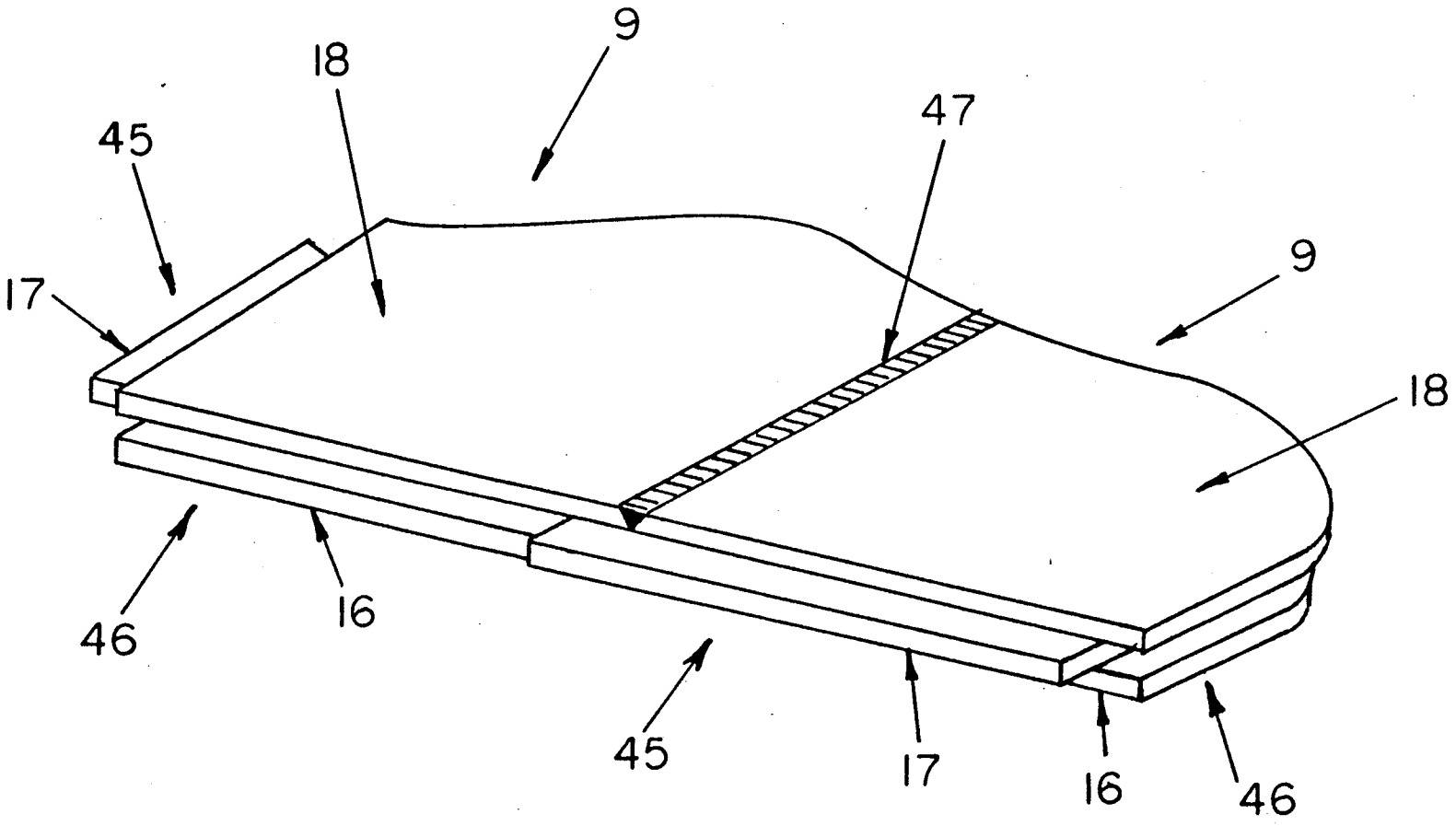
FIG. 19 is an isometric view of a portion of two laminated shell assemblies illustrating a method of joining, using tongue and groove interfaces.

FIG. 19 is an isometric of two laminated plate assemblies 9, illustrating the joining of these assemblies using a tongue 45 and groove 46 design. The tongue 45 and groove 46 can be formed by interior plate 18, center plate 17, and exterior plate 16, of similar dimensions, sandwiching them together and shifting the center plate 17 on a diagonal. In this configuration the three plates can be joined together forming two tongues 45 on adjacent edges and two grooves 46 on the other edges. Joining of these laminated shell assemblies 9, is accomplished by a butt weld 47 between interior plates 18 of adjacent laminated shell assemblies 9, and exterior plates 16 of adjacent laminated shell assemblies 9. This eliminates the need to cut plates to form the tongues 45 and grooves 46.

Figure 20:
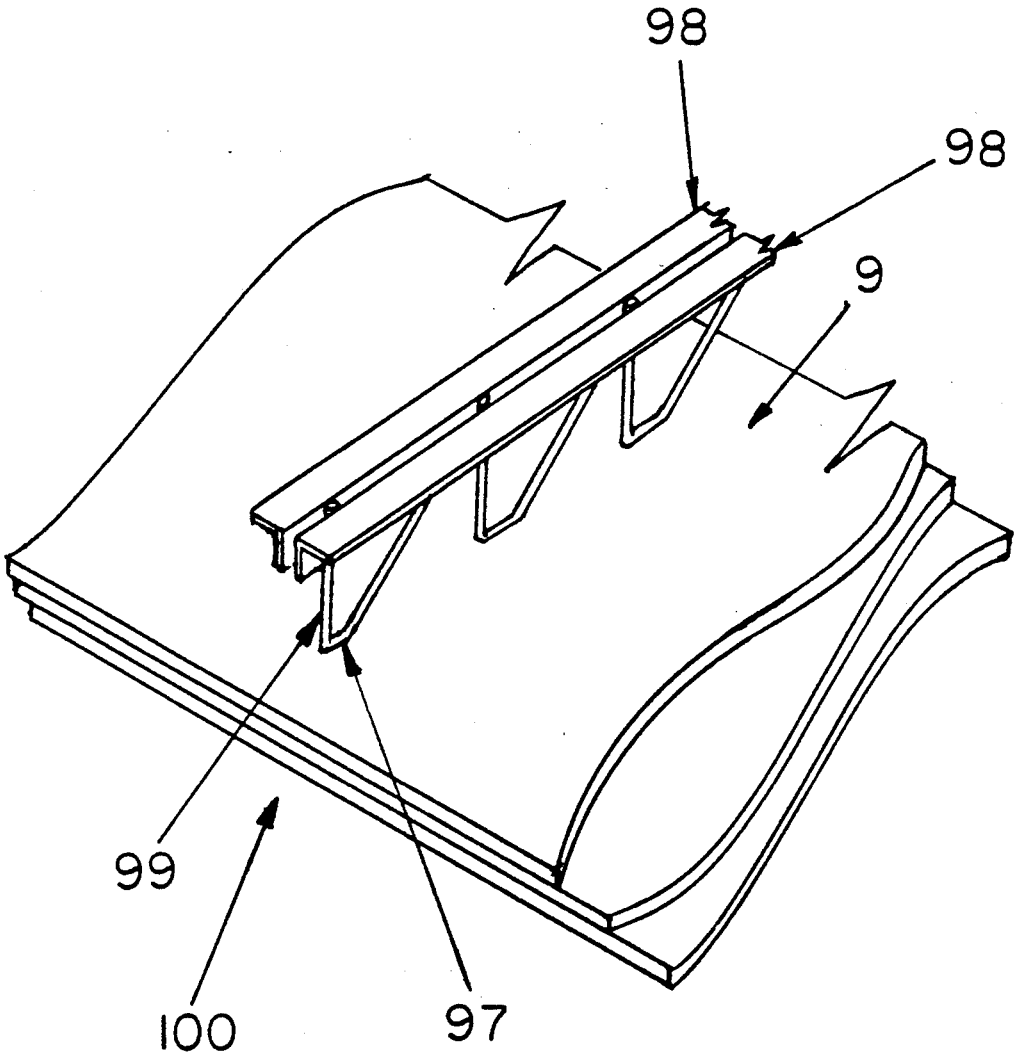
FIG. 20 is an isometric view of a portion of a laminated plate assembly illustrating the use of bar support for laminated plate assembly stiffening.

FIG. 20 is an isometric of the laminated plate assembly 9, were an intermediate bar support 99 has been formed by bent steel bars which have a welding flat 97. The ends of the intermediate bar support 99 are welded to a bar flange 98. The combination of the laminated plate assembly 9, the intermediate bar support 99 and the bar flange 98, form a stiffened laminated plate assembly 100 which uses truss-like behavior to provide additional stiffness to resist bending of the laminated plate assembly 9.

We claim:

1. A structural auxiliary hull, to provide a boundary in addition to a primary hull, said auxiliary hull comprising:

a shell and structural members, wherein said shell is supported by said structural members, arranged in a geometric pattern, wherein the ends of one or more said members meet in proximity of discrete connection points, for load transfer, on the shell of said primary hull, and said shell of said auxiliary hull, and;

wherein a portion of said structural members, for ease in fabrication, are comprised of at least two elements, and;

wherein said structural members, for additional structural integrity, are assemblies comprised of at least two telescoping elements connected by a restrained engagement whereby said telescoping members can support load by one of telescoping movement, deformation of said restrained engagement, and both telescoping movement and deformation of said restrained engagement.

2. A device as set forth in claim 1, wherein said structural members, for energy absorption, are assemblies comprised of at lest two elements connected by a restrained engagement wherein said members can support load by forces developed along inclines by deformation of said restrained engagement.

3. A structural auxiliary hull as set forth in claim 1, wherein a portion of said structural members are connected to said primary and said auxiliary hulls using devices with a base for attachment to said auxiliary or said primary hull, and at lest one appendage for mating with said structural member to facilitate assembly over a range of said member lengths.

4. A structural auxiliary hull as set forth in claim 1, wherein a portion of said structural members are comprised of primary members, attached to said primary hull and said auxiliary hull, and horizontal members and intermediate diagonal members, which connect int he proximity of each other along said primary member forming a structural assembly.

5. A structural auxiliary hull as set forth in claim 1, wherein a portion of the volume created between said primary and said auxiliary hulls contains material.

6. A structural auxiliary hull as set forth in claim 1, wherein a portion of said auxiliary hull shell is comprised of laminated plate assemblies.

7. A structural auxiliary hull as set forth in claim 6, wherein a portion of said auxiliary hull shell is comprised of said laminated plate assemblies joined together using tongue and groove joints.

8. A structural auxiliary hull as set forth in claim 6, wherein a portion of said auxiliary hull shell is comprised of said laminated plate assemblies joined together along the perimeter of said plate assemblies using tongue and groove pieces.

9. An auxiliary hull according to claim 1 including a construction support assembly, to transfer loads from dry-docking, comprising:

an upper yoke assembly, which is comprised of a lower support plate, an upper support plate, and said plates which form a slot; and a lower support assembly comprised of a vertical plate and a reinforced horizontal plate to support block material.

* * * * *